United States Patent [19]

Hull

[11] 4,135,094

[45] Jan. 16, 1979

[54] METHOD AND APPARATUS FOR REJUVENATING ION SOURCES

[75] Inventor: Charles W. Hull, Sierra Madre, Calif.

[73] Assignee: E. I. Du Pont de Nemours and Company, Wilmington, Del.

[21] Appl. No.: 819,388

[22] Filed: Jul. 27, 1977

[51] Int. Cl.[2] ..... H01J 27/00

[52] U.S. Cl. ..... 250/427; 250/423 R; 313/359

[58] Field of Search ..... 204/219; 250/492 R, 250/492 A, 427, 423 R; 313/230, 359, 362

[56] References Cited

U.S. PATENT DOCUMENTS 3,393,339 7/1968 Hill et al. ..... 313/359

*Primary Examiner*—Harold A. Dixon

[57] ABSTRACT

Ion sources which become coated with insulative materials are rejuvenated by forming the repeller electrode in the ion source of gold and bombarding such repeller electrode with ions to sputter the gold onto the coated surfaces to render them conductive again. Gold sputtering is accomplished by bombarding the gold repeller electrode with inert argon ions.

To perform this method, the slit of the extractor plate on the ion source is greatly reduced in cross-sectional area such that the normally higher sputtering pressures may be maintained within the ion source itself. If a direct sample probe is used, it too may be formed of gold and used to provide the gold sputtering source.

10 Claims, 4 Drawing Figures

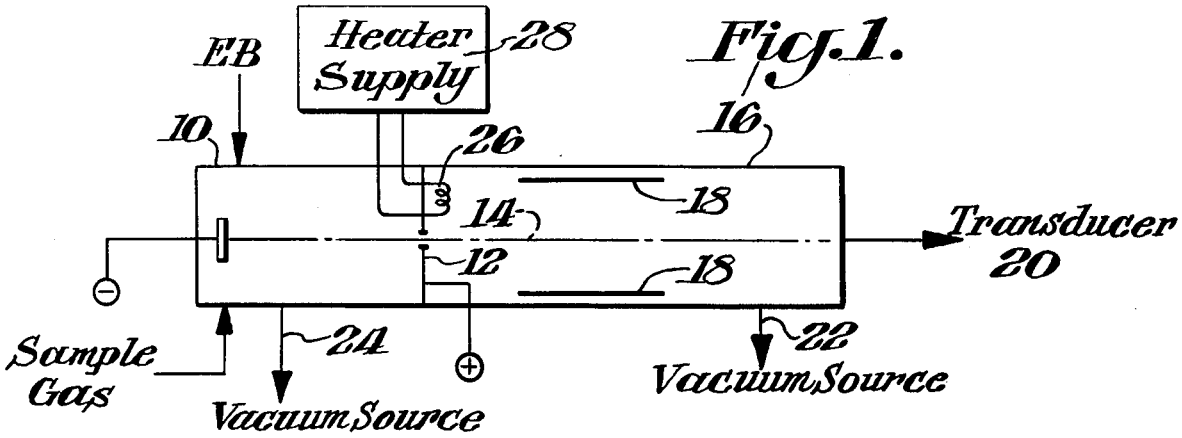
Fig. 1.
Fig. 2.
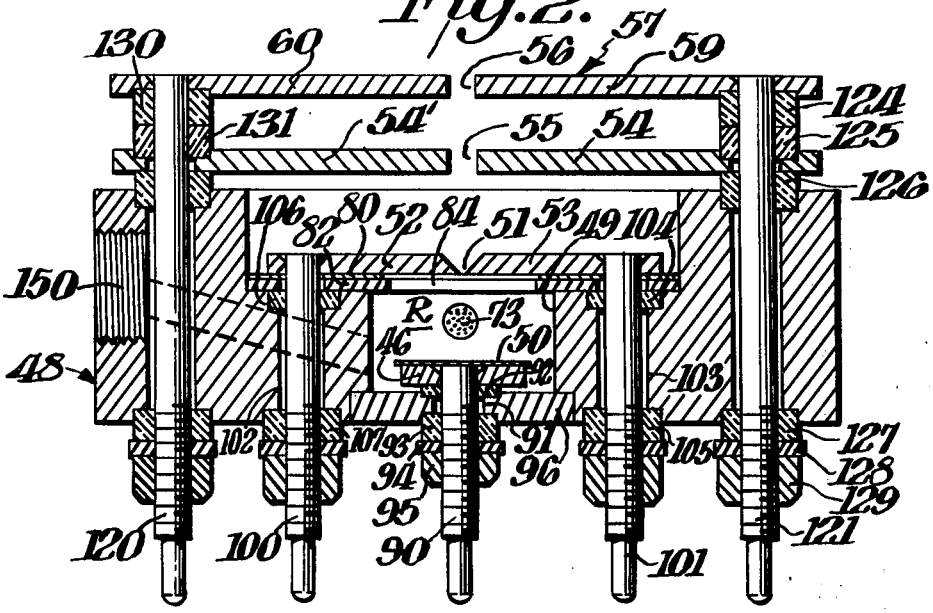
Fig. 3.
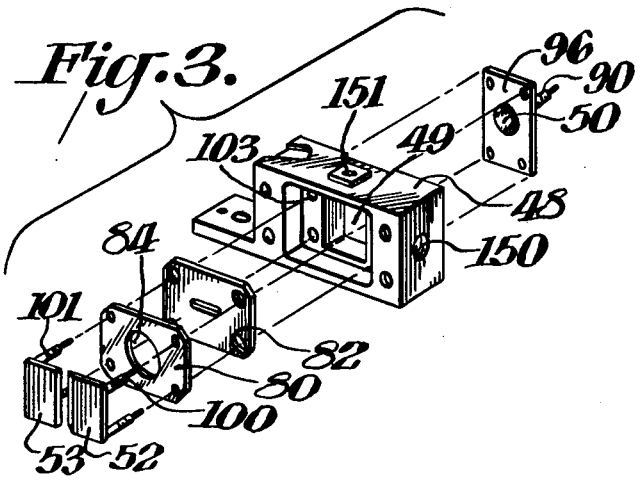
Fig. 4.
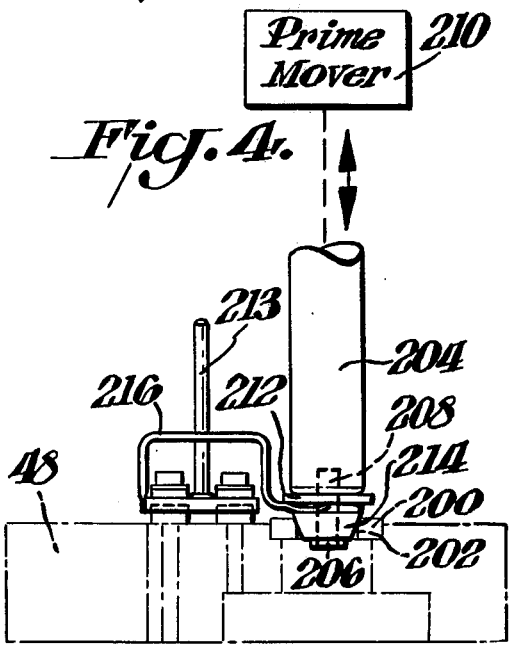

METHOD AND APPARATUS FOR REJUVENATING ION SOURCES

BACKGROUND OF THE INVENTION

This invention relates to ion sources and, more particularly, to a method and apparatus for rejuvenating ion sources.

One of the problems encountered in many electron bombardment or chemical ionization type ion sources that are often used with mass spectrometers is that the performance deteriorates with use. This problem typically arises because of the buildup of electrically insulating deposits within the ionizing chamber itself due to reactions between the charged particles and other materials in the chamber. For example, many samples that are analyzed can themselves cause such insulating coating.

These insulating coatings are a problem because they tend to mask the operation of the source electrodes and thereby degrade the performance of the ion source. The problem is readily corrected by shutting off the mass spectrometer and disassembling and cleaning the entire ion source. Unfortunately, this can be unduly time consuming.

A similar problem arises in the mass analyzer portion of a mass spectrometer since the deflecting electrodes, quadrupole electrodes and the like can also become coated with an undesired electrically insulating type coating. When such a coating occurs, the electric field required of such plates becomes distorted and performance is degraded.

Accordingly, it is an object of this invention to provide an improved method for rejuvenating ion sources.

A further object of this invention is to provide an improved apparatus for rejuvenating ion sources.

SUMMARY OF THE INVENTION

According to the method of this invention, an ion source having cathode and anode electrodes and a sample inlet can be rejuvenated by introducing an ionizing gas through the sample inlet to obtain a suitable ionizing pressure in the source, forming the anode electrode of a sputtering metal, ionizing the ionizing gas to form ions, and, finally, applying a negative electrical potential to the anode electrode such that it is more negative than the remainder of the source thereby to bombard the anode electrode with said ions to sputter said metal onto the interior of said source. In a preferred method of the invention, the metal is gold and the ionizing gas is argon.

An ion source having a vacuum chamber, an inlet to the chamber for introducing a sample gas into the chamber, electrode means for withdrawing ions from said chamber, and means for ionizing the gas is improved to have the capability of rejuvenating said source by having means for introducing an ionizing gas into the chamber, means to evacuate the chamber to an ion sputtering pressure in the presence of said ionizing gas, a metal sputtering electrode in the chamber, and means for applying an ion accelerating potential between said chamber and said sputtering electrode for sputtering said sputtering electrode metal onto the interior surfaces of said chamber.

In a preferred apparatus of this invention, the sputtering electrode is the repeller electrode of said ion source and is formed of gold and the ionizing gas is argon.

In another aspect of the invention, the ion source is part of a mass analyzer having ion deflecting elements. A filament or container of metal to be evaporated is provided with means to evaporate the metal so as to coat the elements with said metal.

Using the apparatus and method of this invention, the internal elements of an ion source and, in fact, the internal elements of a mass analyzer are readily rejuvenated, not by removing the insulative coatings that tend to degrade their performance, but rather by coating them with gold by either a sputtering or evaporating technique. Sputtering is preferred within the ion chamber itself since the elements normally employed in the chamber may be substantially the same and only the voltages and gas pressures changed. In the mass analyzer portion, however, evaporation techniques are preferred since this is a simpler technique.

BRIEF DESCRIPTION OF THE DRAWINGS

The embodiments of this invention and their advantages can be more readily understood by referring to the accompanying drawings in which:

FIG. 1 is a partial block, partial schematic diagram representing a typical mass spectrometer with which this invention may be used;

FIG. 2 is a cross-sectional view of the ion source portion of the mass analyzer depicted in FIG. 1 showing the manner in which the interior of the ionizing source may be constructed for sputtering with gold or other metal;

FIG. 3 is an exploded view of portions of the ion source shown in FIG. 2 that are particularly modified in accordance with this invention; and FIG. 4 is a partial cross-sectional view showing an alternative sputtering metal source that may be used in connection with the ion source of FIGS. 1 and 2 for sputtering gold onto the interior of the source.

DETAILED DESCRIPTION OF THE PREFERRED EMBODIMENTS

As has been described, the ion sources in mass spectrometers often become contaminated by sample materials which are passed into the ion source. This contamination is brought about by the various sample materials or reaction products of these materials becoming deposited on various surfaces within the interior of the ion source itself. Such deposition causes the surfaces to become electrically insulative to varying degrees with the result that the performance of the source itself is degraded. This degradation of course is the result of the distortions of the electric field therein.

It is possible to remove the insulating deposits utilizing ion bombardment within the chamber. Unfortunately, however, ion bombardment techniques are relatively slow and unduly time consuming. The only other alternative is, as noted, to completely disassemble the source and to mechanically and chemically clean it. This, of course, is equally time consuming and undesirable because of the requirement for handling and assembling "clean" parts.

According to the method of this invention, the interior of the ion source is simply coated over with a conductive metal coating by sputtering from one of the electrodes within the source itself. The metal deposited by sputtering is a result of the ion bombardment of a target. The target in this case is one of the electrodes which preferably is formed of a chemically stable material such as gold. Hence, according to this invention an easily ionized gas, preferably an inert gas, such as argon or the like or any other inert or gas mixture normally present in the ion source itself, is introduced into the region between the anode and cathode of a conventional ion source to which the ion repelling and extracting potentials are normally applied. The ionizing gas is bombarded by the ionizing energy normally used for the source itself, such as an electron beam. The anode or repeller electrode for the source is adjusted in potential such that its potential is negative with respect to the cathode electrodes and the remainder of the chamber. The gas ions thus formed, subjected to the thus modified electric fields within the source, are caused to strike the target or anode electrode, in this case, made of gold, causing atoms of the target to be ejected (sputtered) therefrom at high velocity. They (the atoms) are ejected in various directions generally toward the cathode surface, i.e., the exit slit electrodes of the ionizing chamber, and form a deposit over the exposed cathode surfaces. They gradually cover the contaminating insulating material and provide a renewed or rejuvenated metallic coating so that the electric fields are restored to their original condition.

This method finds use in conventional mass spectrometers such as that depicted in the block diagram of FIG. 1. As may be seen with reference to this figure, the ion source 10 is of a conventional type having an output extractor or cathode electrode 12 (typically a plurality of extractor or cathode electrodes are employed to properly form the electric field) such that an ion beam 14 formed therein is caused to pass through the mass analyzer section 16 which may be magnetic, electrostatic or a combination thereof, to selectively deflect and hence pass selected ions as a function of their mass to charge ratio. In the case shown in FIG. 1, these ions are deflected by the electrodes 18, which may be electrodes of a quadrupole type mass spectrometer, to a suitable transducer 20 which detects the presence and quantity of ions.

The mass analyzer section 16 is maintained at a relatively high vacuum as by the vacuum source 22. The ion source likewise is maintained at a relatively low pressure by the vacuum source 24 albeit at a somewhat higher range, typically $10^{-3}$ torr, than the mass analyzer which is typically kept at $10^{-6}$ torr. The vacuum sources may be conventional, typically a diffusion pump or the like.

It often occurs in the mass analyzer section 16 that the various elements such as electrodes 18 also become contaminated with an insulative coating. In this instance, the insulating coating may be simply covered according to the method of this invention by evaporating a suitable conductive metal such as gold or the like from an electric heating coil 26 supplied with electric current from a suitable heating supply 28. This evaporation or flashing takes place under the normal vacuum conditions of the mass analyzer and is a relatively quick and easy procedure to perform. During this vacuum deposition, all potentials are removed from the plates to permit the metallic vapor produced by the coating material to be evenly deposited on the various surfaces within the mass analyzer 16. The surfaces are thus coated or restored to their original electrically conducting condition so that the electric fields are no longer distorted. The evaporator, alternatively, may be a container of metal with an adjoining heater.

To operate effectively as noted, the ion source 10 must be maintained at a higher or sputtering pressure typically in the range of 0.1 torr and above as compared to the normal ion source pressure of 0.001 torr. This may be accomplished in accordance with this invention by modifying a conventional ion source such as that described in U.S. Pat. No. 4,016,421, issued Apr. 5, 1977 to Hull et al. As is described in said Hull et al. patent, the ion source illustrated in FIG. 2, consists of a housing 48 containing a cavity 49 and a plurality of electrodes. Among electrodes are an anode or repeller electrode 50 which is used in accordance with this invention as a sputtering electrode and will hereinafter be so termed. This sputtering electrode 50 may be in the form of a small support disc 46 with a coating of any suitable metal, preferably a relatively high electrical conductivity metal such as gold which is generally stable and nonreactive. A cathode or extractor electrode 51, which may comprise a pair of plates 52 and 53 which are closely spaced with respect to one another, define the first extractor slit. The extractor electrode 51 and the repeller electrode 50 are disposed relative to one another to define an ion forming region R therebetween.

As noted, the extractor electrode or slit 51 is maintained of a relatively small cross-sectional area so as to permit the retention of the relatively high sputtering pressure required within the ionizing region R. This is accomplished by forming a layered structure comprising the plates 52 and 53 sandwiched with an insulator plate 80 such as mica or other suitable material and a field plate 82 formed of a suitable metal similar to that used in the ion source. The seal plate is a solitary plate having a relatively small opening 84 so as to limit the length of the extractor slit 51.

The ion source as it is described in said Hull et al. patent also includes second extractor electrodes 54,54' with a second extractor slit 55 formed thereby; a second focus slit 56 included therein. As was the case with extractor slit 51, the focus electrode comprises two plates 59 and 60 disposed relative to one another to define the focus slit 56.

These six electrodes are disposed in sequential order with the extractor slit 51 disposed in the cavity of the housing 48. In the embodiment illustrated, the electrodes are planar and parallel. It should be understood, however, that any other known configuration may be used. Furthermore, the ion beam source can be operated without the second extractor electrodes 54,54'. All of these electrodes as well as the housing are made from suitable metal such as a nonmagnetic stainless steel or a metal such as sold under the trademark Nichrome V. The electrodes in the ion beam source are supported on various support rods and insulators.

The ion beam source also includes gas inlet means in one side of the chamber 48 as depicted by the internally threaded inlet 150. This inlet 150 may, for example, connect directly to a skimmer nozzle or the like to receive a sample gas to be ionized and analyzed. The inlet 150 includes the slanting passageway which communicates with the ionizing region R. In addition, means is provided for forming an electron beam in the ion forming region R. Any conventional means of forming this beam, as is well known to those skilled in the art of ion optics, may be used. An electron gun would be suitable. In FIG. 2 this source is depicted as an electron beam shown in cross-section 73. The beam is formed simply by an electrode (not shown) which is placed adjacent to the housing 48 at an electron beam aperture in the housing 48. This aperture 151 may comprise nothing more than an orifice in the housing 48 covered by a suitable plate with an electron orifice formed therein as is described in said Hull et al. application. In this instance, the electron beam 73 may be formed by maintaining the electrode at a negative potential relative to the housing 48. The beam may be terminated in a trap (not shown). A potential of around 70 volts usually is sufficient to produce the desired electron beam. It is also desirable to provide a magnetic field in the ion forming region R parallel to the longitudinal axis of the electron beam to columnate the beam. Such field may be provided by a pair of permanent magnets (not shown).

The various electrodes in the ion source are supported in a conventional manner using support rods and insulating beads. The repeller electrode 50 is supported by a partially threaded rod 90 which passes through a channel 91 in the housing 48. Rod 90 is welded to the repeller electrode 50 which has secured thereto as by welding the gold outer layer, although any other suitable connection can be used. The rod 90 provides electrical insulation for the repeller electrode 50 and is insulated from the housing 48 by two insulating washers 92 and 93 which may be made from any suitable material such as saphire. These washers sit in annular recesses formed in the channel 91. A metal washer 94 is provided along with a nut 95 which screws onto the threaded end of the rod 90. Actually the channel 91 is formed in a plate 96 which may be screwed to the cavity 48. The reason for this is that the plate is removable so that alternative repeller electrodes or other sputter sources may be used as desired. It also facilitates easy replacement of the sputter electrode 50.

The sandwiched extractor electrode, comprising the metal plates 52,53, the insulative plate 80 and the seal plate 82 is supported in a similar manner by rods 100 and 101, respectively. An electrical connection is made between each of these rods and the respective plates 52,53 by a welded joint. Enlarged openings in the seal plate 82 permit this plate to be insulated from the rods. The rod 100 passes through a channel 102 in the housing 48 and the rod 101 passes through a channel 103 in the housing. These rods are insulated from the housing by pairs of insulating washers 104, 105, 106, 107, respectively, which fit in annular recesses formed in the housing 48.

In a similar manner, the second extraction electrodes 54 and 54' and the focus plates 59 and 60 are mounted with respect to the housing 48 by rods 120,121. The second extraction electrodes 54 and 54' do not make electrical contact with the rods. The focus plates 59 and 60 are supported by the rods 120 and 121 and their electrical connection is supplied by these rods by a welded joint. Spacing between the plates 59 and 60 and the electrodes 54, 54', as well as the insulation of the rod 121 from the electrode 54, is accomplished by electrically insulating washers 124, 125, 126 and 127, respectively. A metal washer and nut 128 and a nut 129, which fit in the threaded end of rod 121, complete the structure. Beyond the rods shown in FIG. 2, as is seen in FIG. 3, is a complementary set of rods which are substantially identical to those illustrated in FIG. 2.

This ion source may be rejuvenated according to the method of this invention by first introducing preferably an inert gas such as argon at a pressure of about 0.1 torr (any suitable sputtering pressure may be used) into the ionization chamber. This higher pressure is possible because the narrow slit 51 of limited cross-section area prevents excessive leakage into the lower pressure of the mass analyzer 16 (FIG. 1). The electron beam 73 is energized, thereby ionizing the argon gas. The sputtering electrode 50 is biased, contrary to normal practice, at a negative voltage, typically minus 400 volts relative to the housing cavity 48. This sputtering potential forces ions from the beam to bombard the sputtering electrode 50 causing the gold to sputter over the surfaces of the remainder of the ionization chamber. Experience has shown that this treatment is quite beneficial in restoring the source performance. The alternative ionizing gases and sputtering metals may be used as desired.

In an alternative embodiment of this invention, the plate 96 may be replaced with a plate 200 (FIG. 4) having a hole 202 bored therein. This hole may be actually tapered so as to be enlarged or flared outwardly. This hole 202 is adapted to receive a probe 204 such as that normally used to introduce a solid sample into an ionization source. The probe may be positioned into the chamber by a suitable crank or prime move 210, as is conventional. In this instance the probe, which may be formed of an insulating material of known type, has a hollowed end or bore 208 in which is fitted a small gold rod 206. An electrical connection may be made internally in the probe so that the gold rod may be biased to the required negative voltage, as was the sputtering electrode 50, so it in turn may serve as a sputtering electrode in place of the disc 46. The support for this probe is not shown since such probe is well known in the art. Alternatively, an electrical connection may be made by crimping onto the end of the rod 206, as illustrated, a small metal washer 212 which is retained by a frusto-conical shaped washer 214 which may be formed of a suitable ceramic. The rod 206 may be retained by a small tension spring engaging the inside of the bore 208. A wire clip, which may be screwed to the chamber 48 having an electrical connection 212, contacts by a U-shaped spring clip 216, the washer 112 to provide the desired electrical connection.

Having described the structure of this solid sample probe, its operation is substantially identical to that described, the only difference in this case being that the probe itself is formed of the desired sputtering metal so that the separate sputtering electrode need not be formed. The sputtering electrode metal, as well as the ionizing gases, may be selected as desired. The use of the solid sample probe as the sputtering electrode has many advantages. Among these are that the sputtering electrode 206 and its insulator may be easily removed and cleaned without disturbing the mass spectrometer vacuum.

There has thus been described a relatively simple method and apparatus for rejuvenating ion sources. This method and apparatus utilizes a simple technique of coating the ionizing chamber with a thin layer of a conductive metal in place without having to shut down the mass spectrometer to restore its performance. This coating is on the internal portion of the ionization chamber and simply covers over the insulating deposits which normally occur with use. The sputtering electrode itself desirably is of relatively small area and preferably centered closely adjacent to the cathode or extractor electrodes so as to maximize the coating at the extractor slit where most of the insulating coating occurs. If too large an area is provided, the gas ions are attracted usually to one edge and do not provide a sufficient coating at the extractor slit as desired.

I claim:

1. A method of rejuvenating an ion source having cathode and anode electrodes and a sample inlet comprising the steps of:

introducing an ionizing gas through said inlet to obtain a suitable sputtering pressure in said source;

forming said anode electrode of a sputtering metal, said sputtering metal being gold metal;

ionizing said ionizing gas to form ions; and applying a negative electrical potential to said anode electrode such that it is more negative than the remainder of said source, thereby to bombard said anode electrode with said ions to sputter said metal onto the interior of said source.

2. A method according to claim 1 wherein said ionizing gas is argon.

3. In an ion source having a vacuum chamber, an inlet to said chamber for introducing a sample gas into said chamber, electrode means for withdrawing ions from said chamber, and means for ionizing said gas, the improvement comprising:

means for introducing an ionizing gas into said chamber, said ionizing gas being argon;

means to evacuate said chamber to an ion sputtering pressure in the presence of said ionizing gas;

a gold metal sputtering electrode in said chamber; and means for applying an ion accelerating potential between said chamber and said sputtering electrode that causes ions to impinge on said sputtering electrode for sputtering said sputtering electrode metal onto the interior surfaces of said chamber.

4. In an ion source having a vacuum chamber, an inlet to said chamber for introducing a sample gas into said chamber, electrode means for withdrawing ions from said chamber, and means for ionizing said gas, the improvement comprising:

means for introducing an ionizing gas into said chamber;

means to evacuate said chamber to an ion sputtering pressure in the presence of said ionizing gas;

a metal sputtering electrode in said chamber; and means for applying an ion accelerating potential between said chamber and said sputtering electrode that causes ions to impinge on said sputtering electrode for sputtering said sputtering electrode metal onto the interior surfaces of said chamber, said chamber having a sample probe for introducing a solid sample into said chamber, said probe forming said sputtering electrode.

5. An ion source according to claim 4 wherein said sputtering electrode is gold.

6. An ion source according to claim 5 wherein said chamber includes two sample inlets, one for said sample probe and one for said sample gas.

7. An ion source according to claim 6 wherein said sputtering electrode normally is a repeller electrode for said source.

8. An ion source according to claim 7 wherein said electrode means seals said chamber and forms a slit of reduced cross-sectional area to maintain said sputtering pressure in said chamber.

9. In an ion source having a vacuum chamber, an inlet to said chamber for introducing a sample gas into said chamber, electrode means for withdrawing ions from said chamber, and means for ionizing said gas, the improvement comprising:

means for introducing an ionizing gas into said chamber;

means to evacuate said chamber to an ion sputtering pressure in the presence of said ionizing gas;

a metal sputtering electrode in said chamber; and means for applying an ion accelerating potential between said chamber and said sputtering electrode that causes ions to impinge on said sputtering electrode for sputtering said sputtering electrode metal onto the interior surfaces of said chamber, said ion source being part of a mass analyzer having ion deflecting elements, said mass analyzer having electrical heating means for evaporating a metal, thereby to coat said elements with said metal.

10. An ion source according to claim 9 wherein said metal is gold.

* * * * *